US010786134B2

(12) United States Patent
Li et al.

(10) Patent No.: US 10,786,134 B2
(45) Date of Patent: Sep. 29, 2020

(54) FLOOR CLEANER AND WATER CHANNEL

(71) Applicant: HiZero Technologies Co., Ltd., Shenzhen (CN)

(72) Inventors: Yang Li, Guangdong (CN); Yong Zhang, Shenzhen (CN)

(73) Assignee: HIZERO TECHNOLOGIES CO., LTD., Shenzhen (CN)

( * ) Notice: Subject to any disclaimer, the term of this patent is extended or adjusted under 35 U.S.C. 154(b) by 276 days.

(21) Appl. No.: 16/025,265

(22) Filed: Jul. 2, 2018

(65) Prior Publication Data

US 2018/0310795 A1 Nov. 1, 2018

Related U.S. Application Data

(63) Continuation of application No. 15/122,432, filed as application No. PCT/CN2015/091685 on Oct. 10, 2015, now Pat. No. 10,022,032.

(51) Int. Cl.

| | |
|---|---|
| ***A47L 11/40*** | (2006.01) |
| ***A47L 11/282*** | (2006.01) |
| ***A47L 11/30*** | (2006.01) |
| ***A47L 11/292*** | (2006.01) |
| ***A47L 11/18*** | (2006.01) |

(52) U.S. Cl.

CPC ..... *A47L 11/4088* (2013.01); *A47L 11/185* (2013.01); *A47L 11/282* (2013.01); *A47L 11/292* (2013.01); *A47L 11/302* (2013.01); *A47L 11/40* (2013.01); *A47L 11/4022* (2013.01); *A47L 11/4027* (2013.01); *A47L 11/4041* (2013.01)

(58) Field of Classification Search

CPC ..... A47L 11/4088; A47L 11/282; A47L 11/4027; A47L 11/4022; A47L 11/4041

See application file for complete search history.

(56) References Cited

U.S. PATENT DOCUMENTS

| | | | |
|---|---|---|---|
| 1,770,643 | A | 7/1930 | Giambertoni |
| 2,642,601 | A | 6/1953 | Saffioti |
| 2,881,461 | A | 4/1959 | Parker |
| 3,172,138 | A | 3/1965 | Price |
| 4,959,628 | A | 9/1990 | MacGregor |

(Continued)

FOREIGN PATENT DOCUMENTS

| | | | |
|---|---|---|---|
| CA | 2085267 | A1 | 6/1994 |
| CN | 2241510 | Y | 12/1996 |

(Continued)

OTHER PUBLICATIONS

Korean Office Action cited in Korean Patent Application No. KR10-2018-7013364 dated Apr. 19, 2019.

(Continued)

*Primary Examiner* — Shay Karls

(74) *Attorney, Agent, or Firm* — Cooper Legal Group, LLC

(57) ABSTRACT

The disclosure provides a water channel assembly including a channel shell and a filtering piece. The water channel is disposed on the surface of a cleaning roller in a seal and overturn mode so that the cleaning roller is washed by water flowing in the water channel. The filtering piece is laid in the water channel and faces the surface of the cleaning roller. As a result, the solid trash on the cleaning roller is filtered by the filter element and cannot enter the water channel, thus preventing the blockage of the waterway of the water supply system.

20 Claims, 12 Drawing Sheets

(56) References Cited

U.S. PATENT DOCUMENTS

| | | | |
|---|---|---|---|
| 9,682,399 | B2 | 6/2017 | Utterback |
| 9,713,411 | B2 | 7/2017 | Gardner et al. |
| 2001/0008036 | A1 | 7/2001 | Worwag |
| 2004/0078908 | A1 | 4/2004 | Van Epps, Jr. et al. |
| 2009/0276975 | A1 | 11/2009 | Vines |
| 2015/0082579 | A1 | 3/2015 | Lin |

FOREIGN PATENT DOCUMENTS

| | | | |
|---|---|---|---|
| CN | 2794412 | Y | 7/2006 |
| CN | 101190117 | A | 6/2008 |
| CN | 203263303 | U | 11/2013 |
| CN | 203428324 | U | 3/2014 |
| CN | 203506629 | U | 4/2014 |
| CN | 204105933 | U | 1/2015 |
| DE | 102007052982 | A1 | 5/2009 |
| DE | 202016105299 | U1 | 10/2016 |
| EP | 1203556 | A2 | 8/2002 |
| EP | 2801311 | A1 | 11/2014 |
| FR | 651101 | A | 2/1929 |
| JP | S48-025209 | | 7/1973 |
| JP | S49-5735 | A | 1/1974 |
| JP | S3113169 | A | 10/1978 |
| JP | H09322869 | A | 12/1997 |
| JP | 2001095737 | A | 4/2001 |
| JP | 2004147669 | A | 5/2004 |
| JP | 2005211426 | A | 8/2005 |
| JP | 2012228619 | A | 11/2012 |
| JP | 2012254208 | A | 12/2012 |
| WO | 2008095054 | A1 | 8/2008 |
| WO | 2009018688 | A1 | 2/2009 |
| WO | 201413768 | A1 | 9/2014 |
| WO | 2014137168 | A1 | 9/2014 |

OTHER PUBLICATIONS

Int. Search Report cited in PCT Application No. PCT/CN2015/091682 dated Jul. 7, 2016, 17 pgs.
Int. Search Report cited in PCT Application No. PCT/CN2015/091683 dated Jul. 14, 2016, 15 pgs.
Int. Search Report cited in PCT Application No. PCT/CN2015/091684 dated Jul. 7, 2016, 7 pgs.
Int. Search Report cited in PCT Application No. PCT/CN2015/091685 dated Jul. 20, 2016, 16 pgs.
Japanese Office Action cited in Japanese Application No. 2017-563377 dated Jun. 22, 2018, 7 pgs.
Japanese Office Action cited in Japanese Application No. 2017-563376 dated Jun. 8, 2018, 6 pgs.
EP Search Report cited in EP Application No. 15905701.07 dated Aug. 1, 2018, 7 pgs.
Preliminary Amendment cited in U.S. Appl. No. 15/122,430 dated Aug. 30, 2016, 4 pgs.
Non-Final Office Action cited in U.S. Appl. No. 15/122,430 dated May 7, 2018, 13 pgs.
Reply Non-Final Office Action cited in U.S. Appl. No. 15/122,430 dated Jun. 6, 2018, 21 pgs.
Notice of Allowance cited in U.S. Appl. No. 15/122,430 dated Jul. 26, 2018, 31 pgs.
Preliminary Amendment cited in U.S. Appl. No. 15/122,432 dated Apr. 17, 2018, 6 pgs.
Non-Final Office Action cited in U.S. Appl. No. 15/122,432 dated May 7, 2018, 7 pgs.
Notice of Allowance cited in U.S. Appl. No. 15/122,432 dated May 25, 2018, 21 pgs.
Preliminary Amendment cited in U.S. Appl. No. 15/122,436 dated Aug. 30, 2016, 5 pgs.
Preliminary Amendment cited in U.S. Appl. No. 15/122,436 dated Apr. 18, 2016, 8 pgs.
Notice of Allowance cited in U.S. Appl. No. 15/122,436 dated Jun. 7, 2018, 19 pgs.
Preliminary Amendment cited in U.S. Appl. No. 15/122,437 dated Apr. 17, 2018, 4 pgs.
Non-Final Office Action cited in U.S. Appl. No. 15/122,437 dated May 15, 2018, 7 pgs.
Reply Non-Final Office Action cited in U.S. Appl. No. 15/122,437 dated Jun. 6, 2018, 14 pgs.
Notice of Allowance cited in U.S. Appl. No. 15/122,437 dated Aug. 21, 2018, 19 pgs.
EP Communication cited in EP Application No. 15905701.7 dated Aug. 20, 2018, 1 pg.
Japanese Office Action cited in Japanese Application No. 2017-563378 dated Jun. 28, 2018, 2 pgs.
EP Supplementary Search Report, European Patent Application No. 15905699, dated Aug. 2, 2018.
Corresponding Japanese Patent Application No. 2019-076842, Office Action dated Mar. 11, 2020. English Translation.

FLOOR CLEANER AND WATER CHANNEL

RELATED APPLICATIONS

This application is a continuation of and claims priority to U.S. patent application Ser. No. 15/122,432, filed on Aug. 30, 2016, which is a national phase entry of International Application PCT/CN2015/091685, filed on Oct. 10, 2015. U.S. patent application Ser. No. 15/122,432 and International Application PCT/CN2015/091685 are incorporated herein by reference.

FIELD OF THE DISCLOSURE

The disclosure relates to cleaning equipment, and more particularly to a water channel of a floor cleaner.

BACKGROUND OF THE DISCLOSURE

Conventional cleaners for cleaning ground include brooms, mops and floor wipers, all of which are manual tools. With the development of science and technology, people pose high requirements for cleaners, and vacuum cleaner is developed, which operates to adsorb waste and dust on the ground through negative pressure produced by electric power. However, due to the limitation of the working principle, the vacuum cleaner fails to eliminate the waste and stains firmly attached to the ground. As a result, a new generation of cleaners for cleaning ground is provided. The new generation of cleaners includes a motor and a cleaning roller which is driven by the motor to clean the ground. The new generation of cleaners is also equipped with a water supply system and a water channel for washing the cleaning roller, thus cleaning the ground completely.

To wash the cleaning roller, a water channel is often provided. The water channel is connected to a water supply system and supplies water to wash the cleaning roller, and wastewater produced from washing the cleaning roller is extracted by the water channel. However, some trash on the cleaning roller tends to enter the water channel and blocks the waterway of the water supply system.

SUMMARY OF THE DISCLOSURE

In view of the above-described problems, it is one objective of the disclosure to provide a water channel and a floor cleaner comprising the water channel.

To achieve the above objective, in accordance with one embodiment of the disclosure, there is provided a water channel assembly of a floor cleaner, the water channel assembly comprising:

a channel shell and a filtering piece; wherein the channel shell is concave to form a water channel, the water channel is disposed on a surface of a sponge roller in a seal and overturn mode;

and the filtering piece is laid in the water channel and faces the surface of the cleaning roller.

As an improvement of the disclosure, the water channel assembly further comprises a seal element and a water-squeezing member; the seal element and the water-squeezing member are disposed in the water channel side by side, and are pressed on the surface of the cleaning roller to form a seal fitting; and the filtering piece is disposed in a gap between the seal element and the water-squeezing member.

As an improvement of the disclosure, a contact part of the seal element and the surface of the sponge roller is a bulge made of elastic material.

As an improvement of the disclosure, the filtering piece is a filtering screen, and two ends of the filtering screen are pressed by the seal element and the water-squeezing member on the channel shell, respectively.

As an improvement of the disclosure, the water-squeezing member is made of hard material, and an outer wall thereof contacting the sponge roller is arc-shaped.

The disclosure also provides a floor cleaner, comprising:

a base shell, a cleaning roller for clearing ground, the cleaning roller being disposed on the base shell; wherein the channel shell is concave to form a water channel, the water channel is disposed on a surface of a sponge roller in a seal and overturn mode;

and the filtering piece is laid in the water channel and faces the surface of the cleaning roller.

As an improvement of the disclosure, the water channel assembly further comprises a seal element and a water-squeezing member; the seal element and the water-squeezing member are disposed in the water channel side by side, and are pressed on the surface of the cleaning roller to form a seal fitting; and the filtering piece is disposed in a gap between the seal element and the water-squeezing member.

As an improvement of the disclosure, a contact part of the seal element and the surface of the sponge roller is a bulge made of elastic material.

As an improvement of the disclosure, the filtering piece is a filtering screen, and two ends of the filtering screen are pressed by the seal element and the water-squeezing member on the channel shell, respectively.

As an improvement of the disclosure, the water-squeezing member is made of hard material, and an outer wall thereof contacting the sponge roller is arc-shaped.

Advantages of the water channel assembly of the disclosure are summarized as follows.

The disclosure provides a water channel assembly comprising a channel shell and a filtering piece. The water channel is disposed on the surface of a cleaning roller in a seal and overturn mode so that the cleaning roller is washed by water in the water channel. The filtering piece is laid in the water channel and faces the surface of the cleaning roller. As a result, the solid trash on the cleaning roller is filtered by the filter element and cannot enter the water channel, thus preventing the blockage of the waterway of the water supply system.

DETAILED DESCRIPTION OF THE EMBODIMENTS

Example 1

Figure 1:
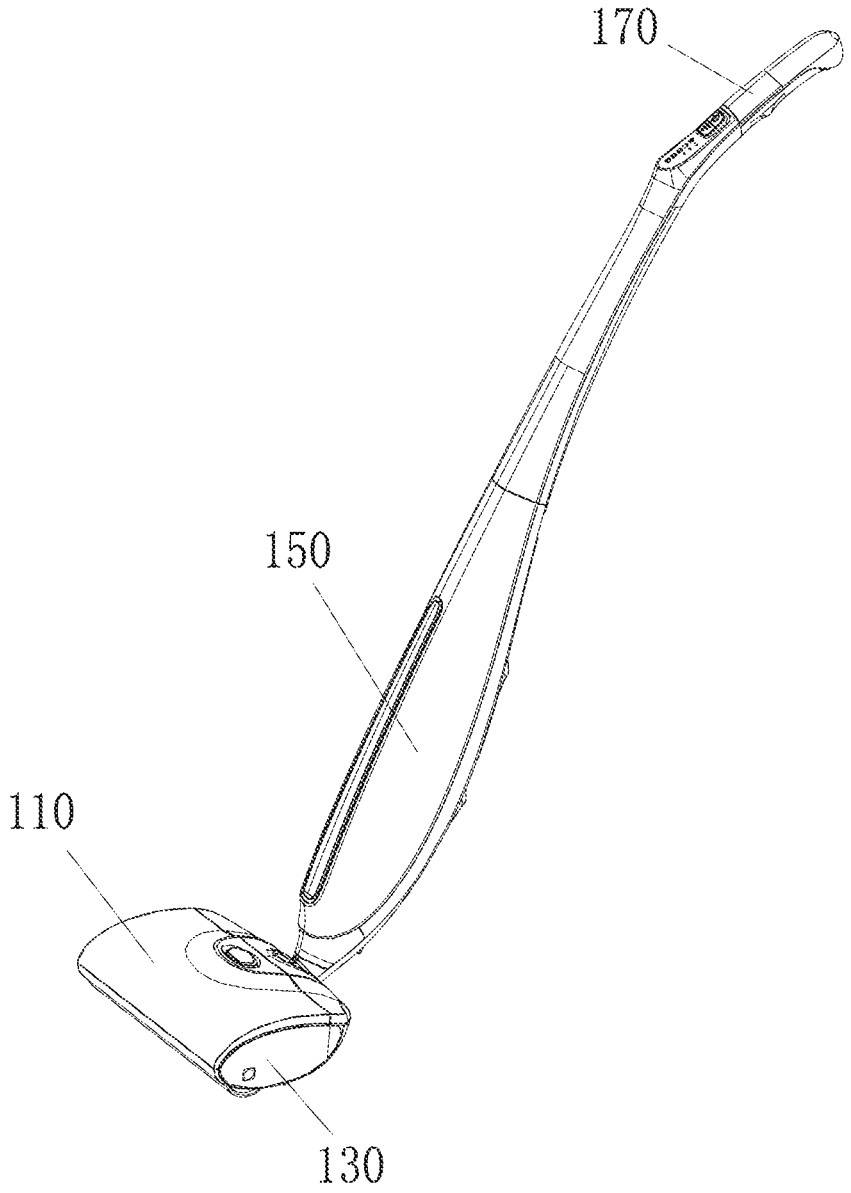
FIG. 1 is a schematic diagram of a floor cleaner of the disclosure.

To prevent the blockage of the water supply system of a floor cleaner, a novel water channel assembly is provided.

The water channel assembly comprises a channel shell and a filtering piece.

In use, the surface of the cleaning roller needs washing regularly or irregularly. The channel shell is concave to form a water channel, and the water channel is disposed on the surface of a sponge roller in a seal and overturn mode. The water channel communicates with the clean water tank and the wastewater tank of the water supply system, and the clean water tank operates to provide clean water and the wastewater tank operates to extract wastewater. The surface of the cleaning roller is washed by the clean water in the water channel, and the produced wastewater is extracted from the water channel.

To prevent the trash on the cleaning roller from entering the waterway of the water supply system, particularly the wastewater waterway, the filtering piece is laid in the water channel and faces the surface of the cleaning roller. Specifically, the filtering piece can be pasted on the surface of the cleaning roller.

The sealing of the water channel and the surface of the cleaning roller can be achieved according to different structures.

The water channel assembly further comprises a seal element and a water-squeezing member; the seal element and the water-squeezing member are disposed in the water channel side by side, and are pressed on the surface of the cleaning roller to form a seal fitting; and the filtering piece is disposed in a gap between the seal element and the water-squeezing member.

Preferably, to decrease the resistance of the seal element acting on the cleaning roller, the contact part of the seal element and the surface of the sponge roller is a bulge made of elastic material. As result, the contact of the seal element and the surface of the sponge roller is a soft contact, which, on the one hand, decreases the resistance of the seal element acting on the cleaning roller, on the other hand, improves the sealing effect of the seal element.

The water-squeezing member operates to squeeze out the water of the cleaning roller. The water-squeezing member is disposed at one side of the water-discharging channel of the clearing roller and made of hard material, and an outer wall thereof contacting the sponge roller is arc-shaped, which facilitates the squeezing of the water, and decreases the resistance against the cleaning roller.

Furthermore, the seal element and the water-squeezing member are locked on the channel shell using bolts. The filtering piece is a filtering screen, and two ends of the filtering screen are pressed by the seal element and the water-squeezing member on the channel shell, respectively.

Example 2

The disclosure provides a cleaner for cleaning the ground.

The cleaner for cleaning the ground comprises a shell assembly, a cleaning mechanism, a water supply system, a control unit, and a connection mechanism.

The shell assembly is a support of the cleaner, and comprises two parts, one is a base, and the other is a handle. The base and the handle is connected by the connection mechanism. The connection mode is flexible, so that the user can conveniently operate the cleaner with different angles.

The cleaning mechanism is a key part to clean the ground and is disposed on the base. The water supply system comprises a clean water tank and a wastewater tank. The clean water tank is configured to store clean water and communicates with the cleaning mechanism. Clean water is transported to the cleaning mechanism through a power unit to clean the cleaning mechanism. The wastewater tank is configured to store wastewater which is discharged from the cleaning mechanism communicating with the wastewater tank. The wastewater produced by the cleaning mechanism is restored in the wastewater tank via another power unit, thus preventing the wastewater from leaking out of the cleaner.

The control unit comprises a control circuit and a circuit board loading the control circuit. The control unit controls the operation of the cleaner, such as the operation and halt of the cleaning mechanism and the opening and closing of the water supply system, so as to achieve the man-machine interaction.

For better understanding the disclosure, the example defines where the base is located is the front part of the cleaner and the handle is the rear part of the cleaner.

Figure 2:
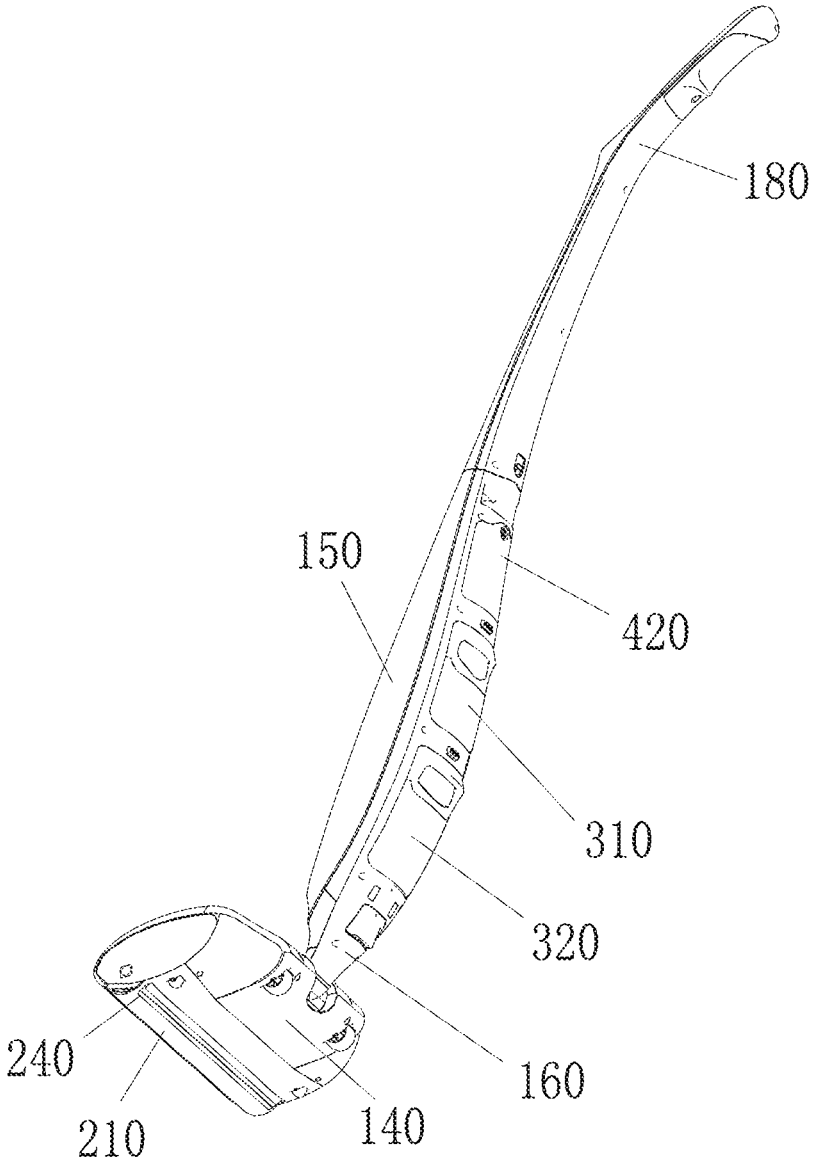
FIG. 2 is a schematic diagram of a floor cleaner in FIG. 1 from another angle of view.
Figure 3:
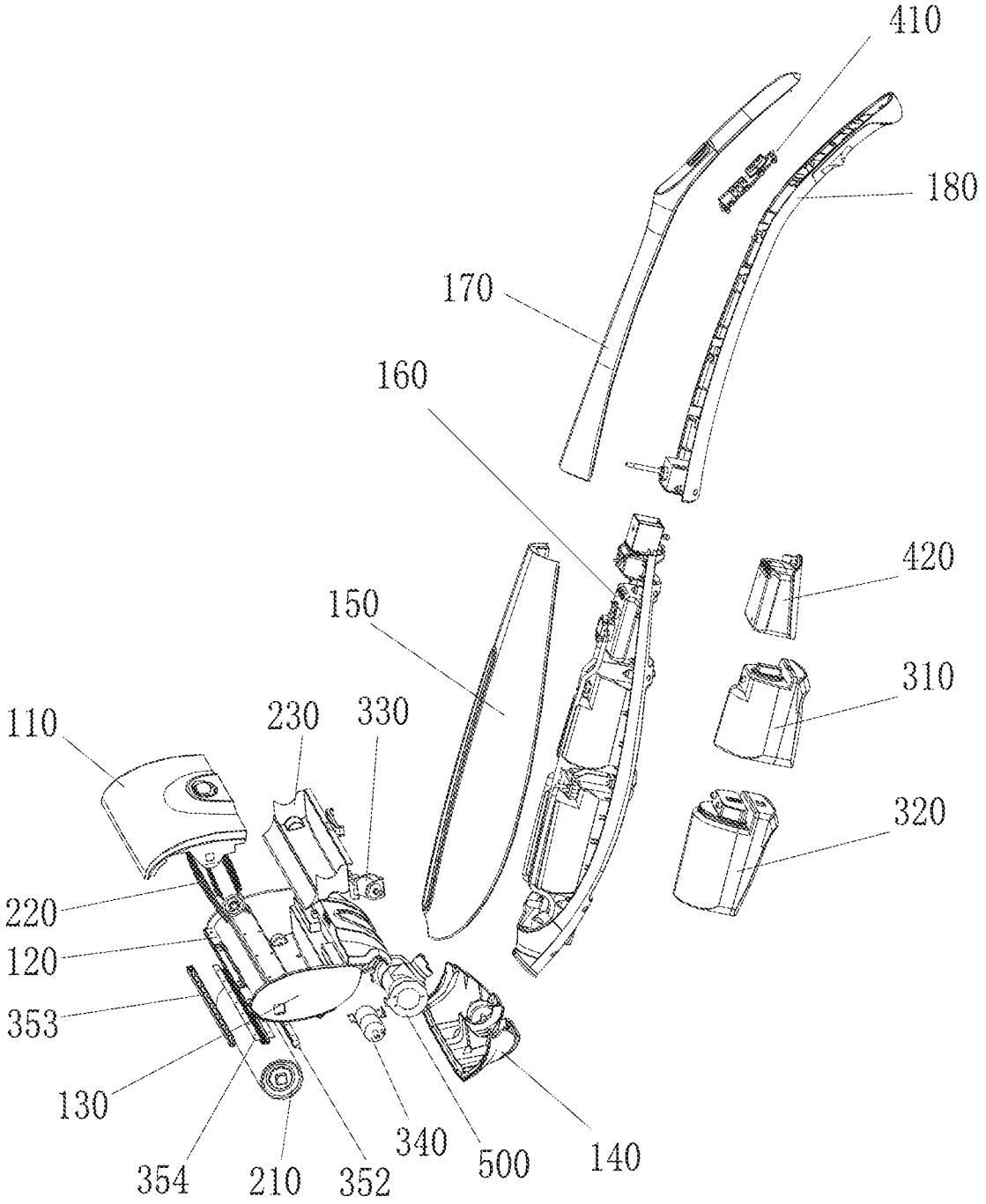
FIG. 3 is an exploded view of a floor cleaner in FIG. 1.

Specifically, as shown in FIGS. 1-3, the base comprises a turnable cover 110, a base shell 120, side shells 130, and a rear shell 140. The turnable cover 110 is disposed above the base shell 120 and may be flipped to open with respect to the base shell 120. The rear shell 140 is disposed at the lower rear of the base shell 120, and the side shells 130 are clamped at two sides of the base shell 120.

Also, as shown in FIGS. 1-3, the handle comprises a handle portion and a body portion. The handle portion comprises a top handle part 170 and a rear handle part 180. The body portion comprises a top body part 150 and a rear body part 160. The handle portion is mounted on the body portion. The body portion is connected to base through the adapter component 500 to realize the connection between the handle and the base.

As shown in FIGS. 3-6, the cleaning mechanism comprises a cleaning roller assembly 210, a clearing component 220 operating to remove trash on the cleaning roller assembly, and a trash bin 230 for collecting the trash on the cleaning roller assembly.

The cleaning roller assembly 210 comprises a cleaning roller. The cleaning roller rollers on the ground to clear the trash. Optionally, the cleaning roller is made of flexible material, for example, in this example, the cleaning roller is a sponge roller 211.

The cleaning roller assembly 210 further comprises a sleeve barrel 213 loading the sponge roller 211, and a power unit 212 for driving the sponge roller 211 and the sleeve barrel 213.

The power unit 212 is disposed on the side wall of the base shell 120 and is locked using a bolt. The side wall is vertical to the ground. The sleeve barrel 213 of the sponge roller 211 is sleeved on the power unit 212 and is replaceable. The sponge roller 211 is sleeved on the sleeve barrel 213, and the power unit 212 is disposed in the sleeve barrel 213. The power unit 212 is optionally a motor, and the opening and closing of the power unit 212 is controlled by the control unit.

Figure 4:
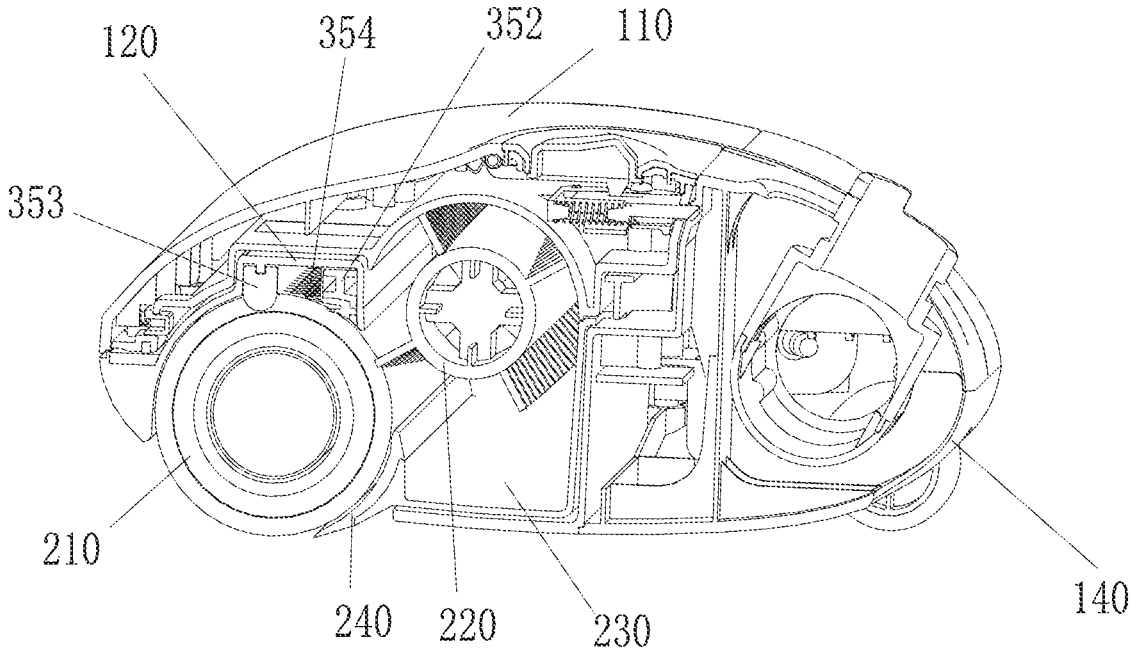
FIG. 4 is a sectional view of a base of a floor cleaner of the disclosure.
Figure 5:
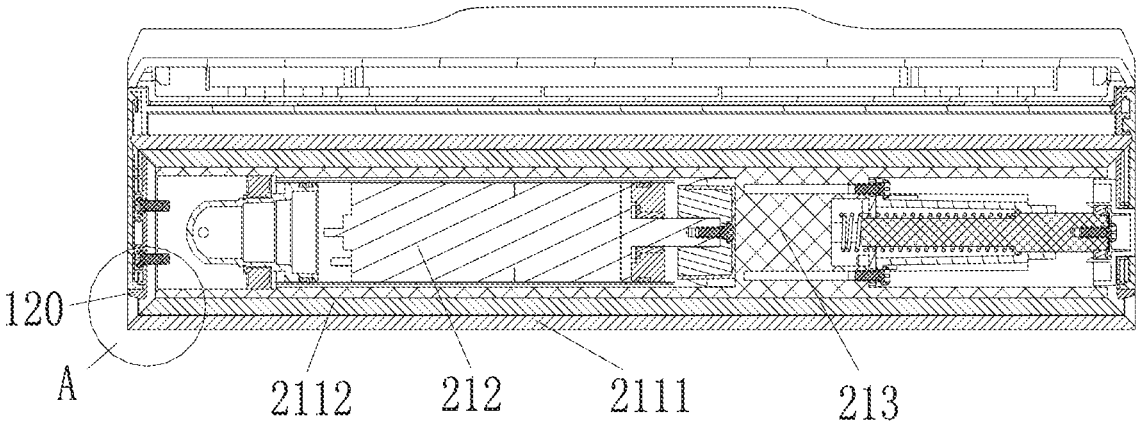
FIG. 5 is a sectional view of a cleaning roller assembly of a floor cleaner of the disclosure.
Figure 6:
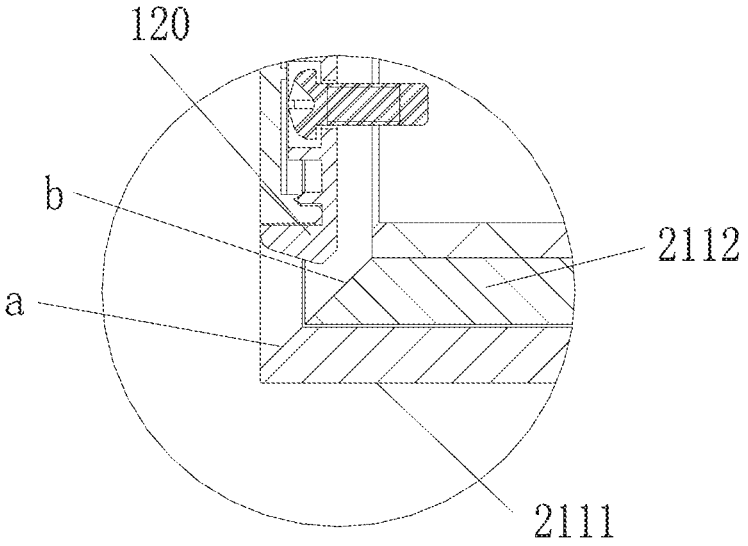
FIG. 6 is an enlarged view of part A in FIG. 5.

As shown in FIG. 4, the trash bin 230 is disposed at the lower rear of the sponge roller 211. Without affecting the rotation of the sponge roller 211, the trash bin can be close to the sponge roller 211 as possibly, so as to prevent the trash from leaking from the gap between the sponge roller 211 and the trash bin 230.

Figure 7:
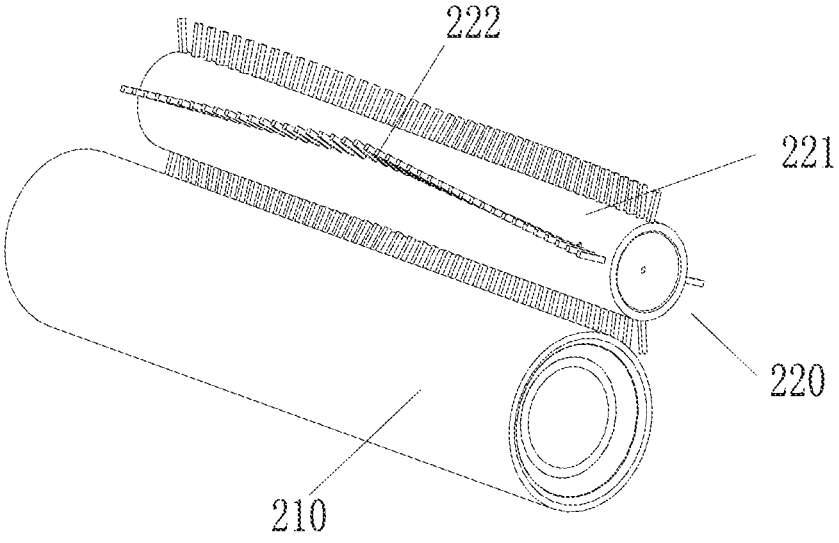
FIG. 7 is a schematic diagram showing the cooperation of a cleaning roller and a clearing component of a cleaner of the disclosure.

As shown in FIG. 7, the clearing component comprises a rotation body 221 and a plurality of clearing elements 222 disposed on the rotation body 221. The rotation body 221 is driven by a power unit (the power unit can be a motor, which is not shown in the drawings) to rotate along with the sponge roller 211 (clockwise or anticlockwise). The clearing elements 222 are strip-shaped, such as hair brush or tooth structures, and rotate with the rotation body 221. The gap between the clearing elements 222 and the sponge roller 211 is smaller than the volume of the trash or the clearing elements 222 and the sponge roller 211 directly contact with each other, so as to clear the trash on the sponge roller 211.

The clearing component 220 is disposed at the upper rear of the sponge roller 211, i.e., above the trash bin 230, so that the trash cleared from the sponge roller 211 falls into the trash bin 230.

To more efficiently clear the trash on the sponge roller 211, as shown in FIG. 7, the clearing elements 222 can be divided into at least two groups, each group comprises a plurality of clearing elements 222 which are disposed along the center line of rotation of the rotation body 221. The length of the clearing elements can be smaller than, larger than, or equal to the length of the sponge roller 211 along the center line of rotation of the rotation body 221.

As shown in FIG. 7, the clearing elements 222 can be aligned, or be disposed in the shape of wave. The latter can reduce the resistance of the clearing elements 222 against the sponge roller 211, thus saving the energy consumption.

Figure 8:
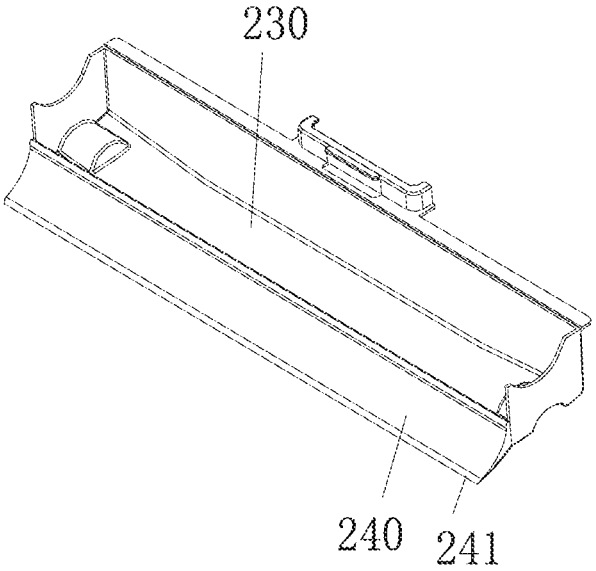
FIG. 8 is a schematic diagram of a trash bin of a cleaner of the disclosure.
Figure 10:
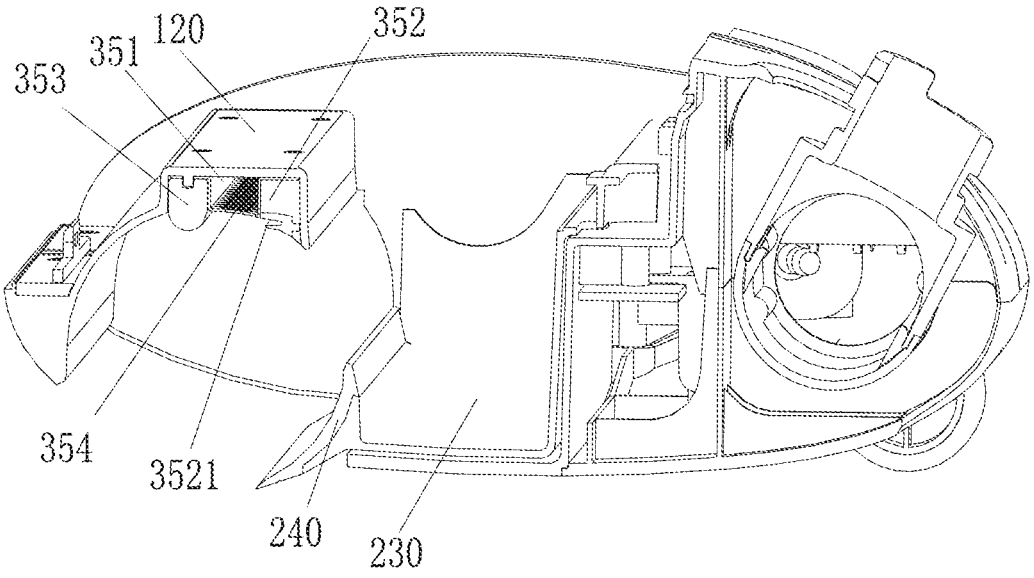
FIG. 10 is a schematic diagram of a water channel (not comprising a cleaning roller assembly) of a cleaner of the disclosure.
Figure 11:
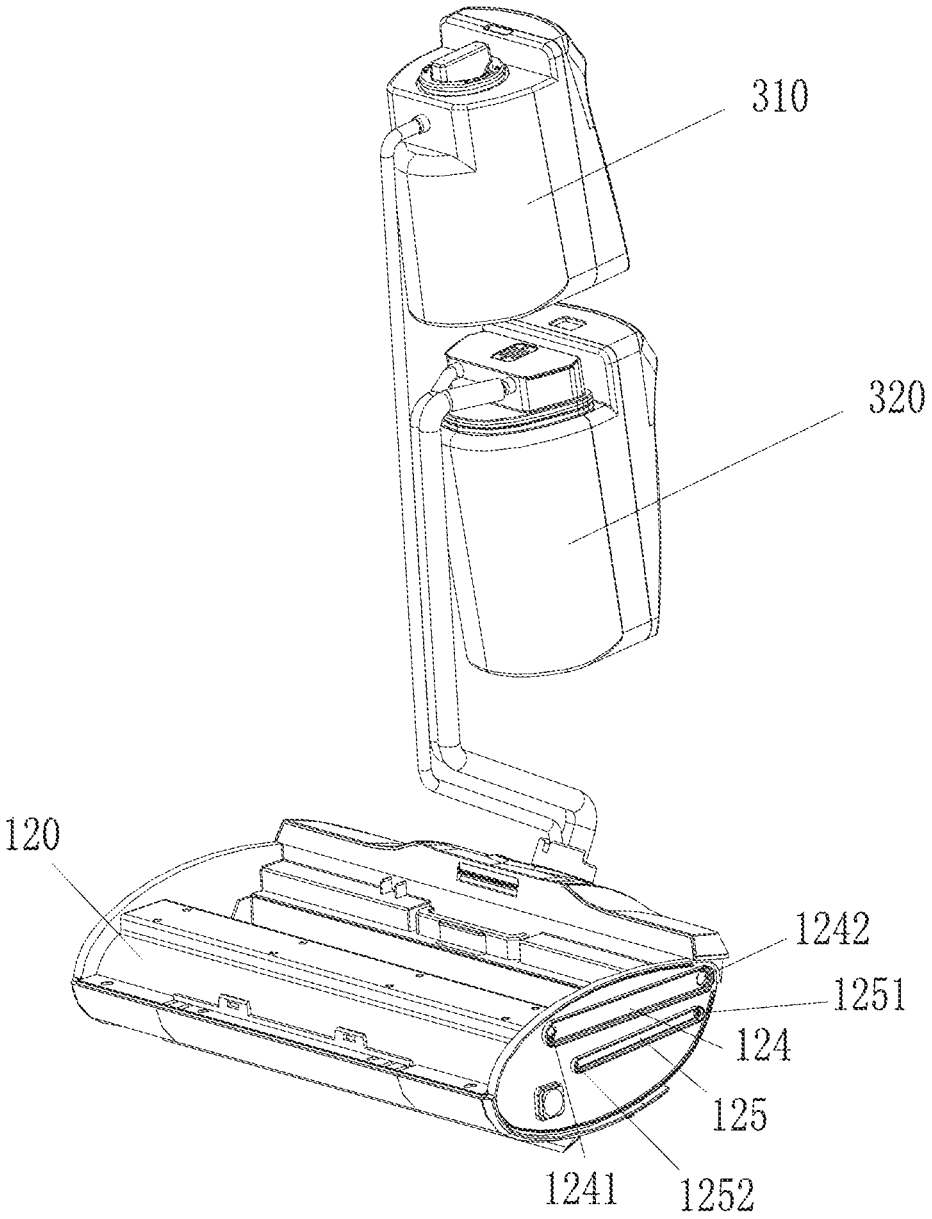
FIG. 11 is a schematic diagram of a water supply system of a cleaner of the disclosure.
Figure 12:
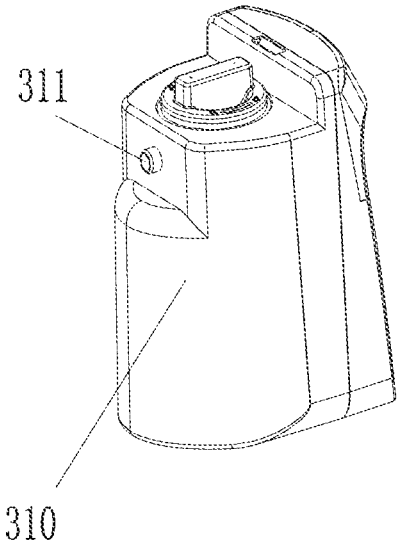
FIG. 12 is a schematic diagram of a clean water tank of a cleaner of the disclosure.
Figure 13:
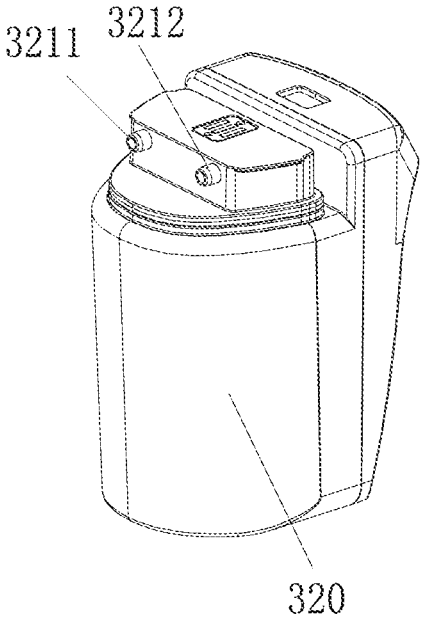
FIG. 13 is a schematic diagram of a wastewater tank of a cleaner of the disclosure.
Figure 14:
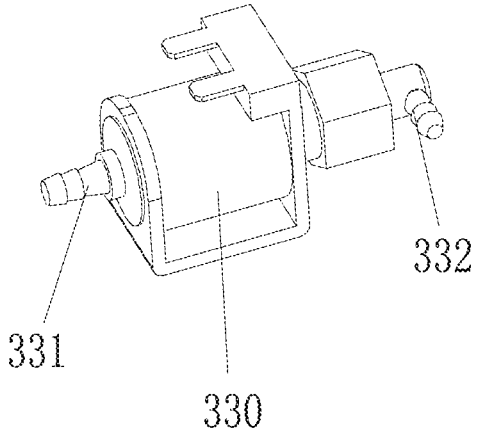
FIG. 14 is a schematic diagram of a water pump of a cleaner of the disclosure.
Figure 15:
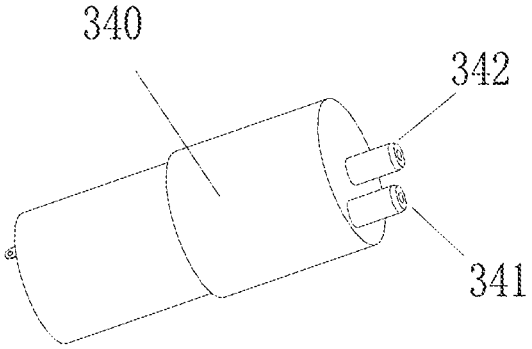
FIG. 15 is a schematic diagram of an air pump of a cleaner of the disclosure.

Furthermore, as shown in FIGS. 4 and 8, to improve the cleaning effect, in the cleaning mechanism, a scraper 240 is disposed at the rear of the sponge roller 211. The scraper 240 comprises a flexible front end 241 made of, for example, rubber. The front end 241 is attached to the ground, thus preventing the trash from omitting from the lower part of the cleaner. As shown in FIGS. 4 and 10, a gap exists between the scraper 240 and the sponge roller 211. The outer wall of the scraper 240 facing the sponge roller 211 is designed as an arc, and thus the gap operates as a guide channel to collect the trash.

As shown in FIGS. 3,4,9 and 11, the water supply system comprises a washing chamber, a clean water tank 310, a clean water supply device (for example, water pump 330), a wastewater tank 320, and a wastewater recovery device (for example, air pump 340).

The washing chamber is disposed on the rotation path of the sponge roller 211 and coordinates with the sponge roller 211 in a sealing mode. The washing chamber is filled with water to wash the sponge roller 211.

Figure 9:
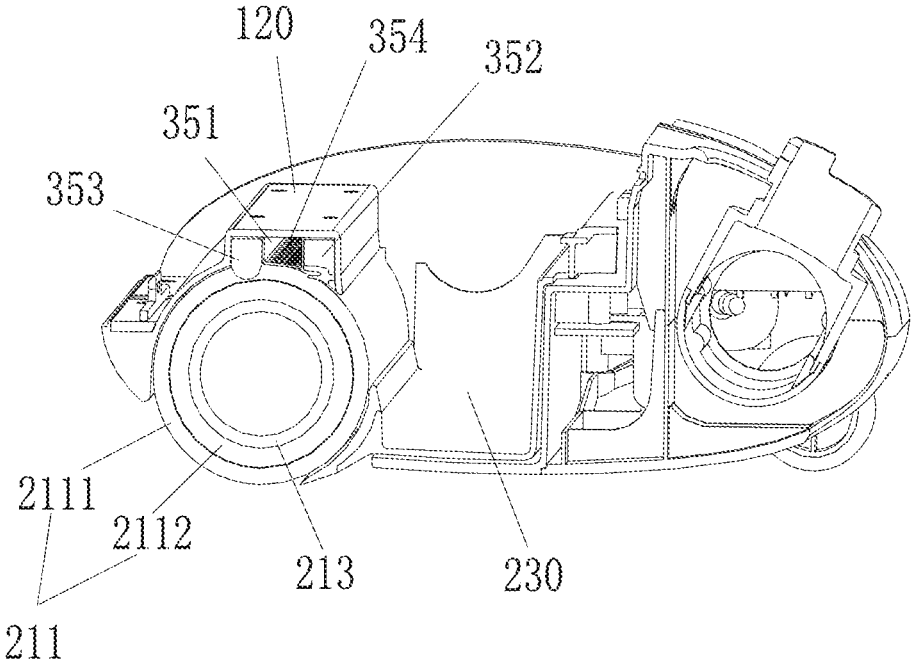
FIG. 9 is a schematic diagram of a water channel (comprising a cleaning roller assembly) of a cleaner of the disclosure.

As shown in FIGS. 9 and 10, the washing chamber is a water channel, or other chambers having a different structure. Part of the base shell 120 (can be regarded as the shell of the water channel) is concave to form the water channel 351, which simplifies the structure of the cleaner. Optionally, the water channel 351 can be an individual structure.

The water channel 351 is pressed on the sponge roller 211 in an overturn mode. The contact regions of the water channel 351 and the sponge roller 211 are sealed. Specifically, a seal element 352 and a water-squeezing member 353 are locked at two sides of the water channel 351 via bolts, respectively. The seal element 352 is behind the water-squeezing member 353, that is to say, the sponge roller first moves to the seal element 352, and then to the water-squeezing member 353. The water-squeezing member 353 and the seal element 352 function as leak proof structures of the water channel 351 and the sponge roller 211, respectively. Additionally, the water-squeezing member 353 operates to squeeze out the water in the sponge roller 211. The wastewater squeezed out from the sponge roller 211 directly flows to the water channel 351, and then collected by the wastewater tank 320.

To improve the water squeezing effect, the water-squeezing member 353 is made of hard material, and the outer wall thereof contacting the sponge roller 211 is arc-shaped. For example, the water-squeezing member 353 are strips or shaft-shaped structures made of rigid plastic or metal. The seal element 352 only has the sealing properties. As shown in FIG. 10, the contact part 3521 of the seal element 352 and sponge roller 211 is a bulge made of elastic material, the elasticity thereof can prevent the trash on the sponge roller 211 from being squeezed out of the water channel 351.

To prevent large solid waste on the sponge roller 211 from entering the water supply system to block the waterway, as shown in FIGS. 9 and 10, a filter 354 is disposed in the water channel 351. Two ends of the filter 354 are pressed in the water channel 351 by the water-squeezing member 353 and the seal element 352.

As shown in FIGS. 3, 11, 12 and 14, the clean water outlet 311 of the clean water tank 310, the clean water inlet (not shown in the drawings) of the water channel 351 communicate with the water pump 330. The water inlet of the water pump communicates with the clean water outlet 311, the water outlet 332 thereof communicates with the clean water inlet. Driven by the water pump 330, clean water enters the water channel 351 via the clean water inlet to wash the sponge roller 211, and then flows out from the wastewater outlet 1241 of the water channel 351.

As shown in FIGS. 3, 11, 13 and 15, the wastewater outlet 1241, the wastewater inlet 3211 of the wastewater tank 320 communicate with the air pump 340. Specifically, the air pump 340 communicates with the air extraction opening 3212 of the wastewater tank 320, and the wastewater outlet 1241 of the water channel 351 communicates with the wastewater inlet 3211 of the wastewater tank 320. The air pump 340 operates to extract the air in the wastewater tank 320 to produce a negative environment, which is favorable to the wastewater tank 320 to absorb wastewater from the water channel 351. Employing the air pump 340 to absorb wastewater can flexibly control the wastewater tank 320 to absorb wastewater as needed.

Optionally, the clean water supply device is not limited to the water pump 330, it can also be an air pump instead of the water pump 330. The air pump communicates with the water channel 351. Through pumping, the pressure in the water channel 351 is decreased, the water channel sucks up clean water from the clean water tank 310. The working principle of the air pump is the same as the principle of the wastewater tank 320 for wastewater recovery.

Likewise, the wastewater recovery device is not limited to the air pump 340, it can also be a water pump instead of the air pump 340. The working principle of the water pump is the same as the principle of the clean water tank 310 for clean water supply.

As shown in FIGS. 3, 11, 13 and 15, because the air inlet 341 of the air pump 340 communicates with the wastewater tank 320, when the air pump 340 is working and the wastewater tank 320 waggles, the produced foams tend to be sucked up by the air pump 340.

To solve the problem, the wastewater tank 320 is modified. The wastewater tank 320 comprises a wastewater storage chamber and at least one splash-proof member. The splash-proof member separates the air extraction opening 3212 of the wastewater tank 320 from the storage chamber. The splash-proof member comprises an air vent communicating with the storage chamber. The air extraction opening 3212 of the wastewater tank 320 communicates with the air vent of the splash-proof member. Most of splashed foams are blocked by the splash-proof member, but the work of the air pump 340 is not affected. The more the splash-proof member, the better the splash-proof effect.

Figure 16:
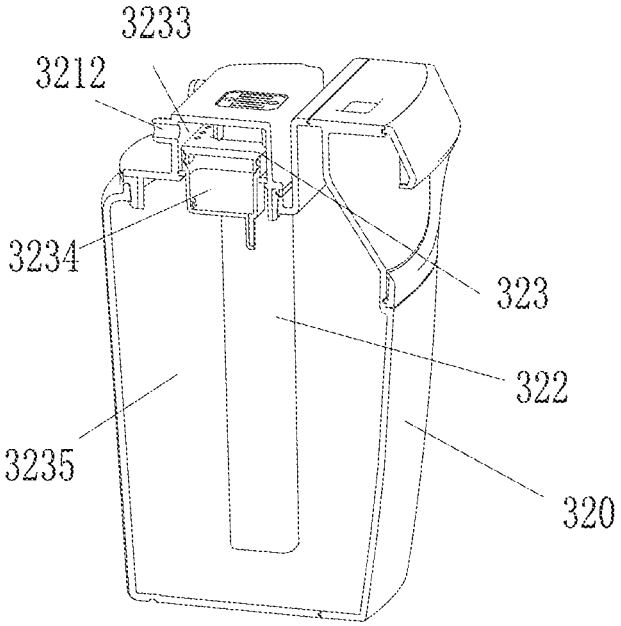
FIG. 16 is a sectional view of a wastewater tank of a cleaner of the disclosure.
Figure 17:
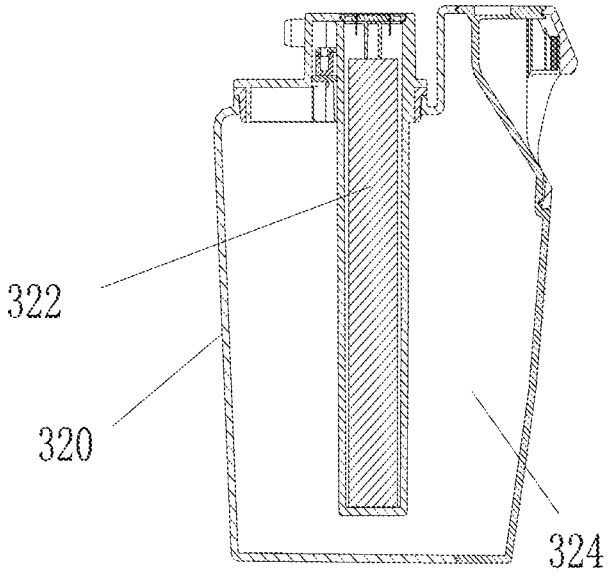
FIG. 17 is a sectional view of a wastewater tank of a cleaner of the disclosure from another angle of view.
Figure 18:
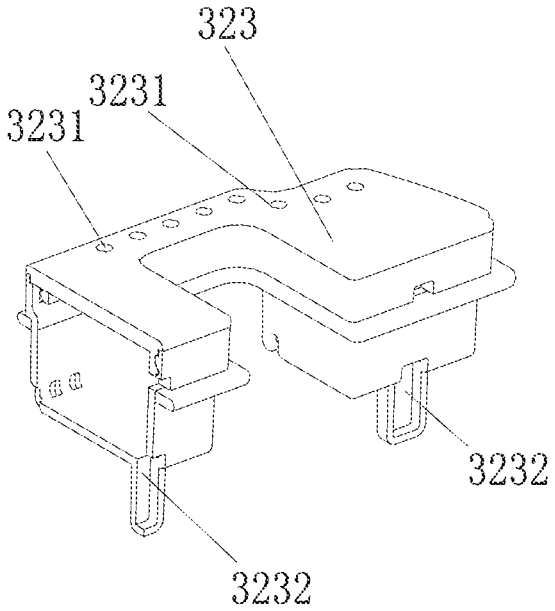
FIG. 18 is a sectional view of a splash-proof member of a cleaner of the disclosure.

Specifically, as shown in FIGS. 16, 17 and 18, the wastewater tank 320 comprises a chamber having the wastewater inlet 3211 and the air extraction opening 3212, a liquid level detector 322 and the splash-proof member 323. The liquid level detector 322 and the splash-proof member 323 both are disposed in the chamber. The liquid level detector 322 operates to detect the liquid level of the wastewater in the wastewater tank 320 and is connected to the control unit. When the wastewater overtakes the maximum, a switch is triggered to send signal to the control unit.

The splash-proof member 323 comprises a first buffer chamber 3234 comprising first air vents 3231 at the top thereof and second air vents 3232 at the bottom thereof. The first air vents 3231 and the second air vents 3232 are disposed at different directions. Specifically, the first air vents 3231 are disposed vertically, and the second air vents 3232 are disposed transversely. The staggered arrangement of the air vents can prevent the water entering from the second air vents 3232 from entering the first air vents 3231.

As shown in FIG. 17, when the splash-proof member 323 is disposed in the chamber, the chamber of the wastewater tank 320 is divided into a second buffer chamber 3233 and an accommodation chamber 3235. The second buffer chamber 3233 and the first buffer chamber 3234 communicate with each other via the first air vents 3231. The air extraction opening 3212 communicates with the second buffer chamber 3233. Therefore, through multiple levels of anti-splash, almost no water is pumped into the air pump 340.

To prevent the foams splashed in the wastewater tank 320 from entering the air pump 340, other options can also be adopted. For example, the air outlet 342 of the air pump 340 communicates with the sponge roller 211 or the water channel 351, and the water absorbed by the air pump 340 is discharged and collected by the sponge roller 211 or the water channel 351.

The waterways of the water channel 351, the clean water tank 310, the water pump 330, the wastewater tank 320, and the air pump 340 can be independent pipes, or be integrated with other structures for simplifying the cleaner. As shown in FIGS. 3 and 10, two sides of the base shell 120 are provided with a clean water channel, a wastewater channel 124, and a water-discharging channel 125. One end of the wastewater channel 124 is the wastewater outlet 1241 of the water channel 351, and the other end thereof is a wastewater adaptor 1242 connected to the wastewater tank 320. One end of the water-discharging channel 125 is a water inlet 1251, and the other end thereof is a water outlet 1252 communicating with the water channel 351 or the sponge roller 211. The clean water channel is disposed at the base shell 120 and opposite to the wastewater channel 124, and comprises an adaptor communicating with the water pump 330 and the clean water inlet of the water channel 351. The structure of the clean water channel is basically the same as that of the wastewater channel 124, so no more detailed description should be provided for the clean water channel. When the side shells 130 at two sides of the base shell 120 are locked on the base shell 120, the clean water channel, the wastewater channel 124, and the water-discharging channel 125 constitute a sealed waterway, thus forming a complete waterway.

To further improve the cleaning effect, the sponge roller 211 can be made much thicker. As a result, when washing the sponge, much more force must be exerted by the water-squeezing member 353 on the sponge roller 211 so as to squeeze water out of the sponge. However, when the squeezing force is much large, the rotation of the sponge roller 211 may be impeded, and to maintain the normal rotation of the sponge roller 211, much more energy must be imposed, thus causing more energy consumption.

Figure 19:
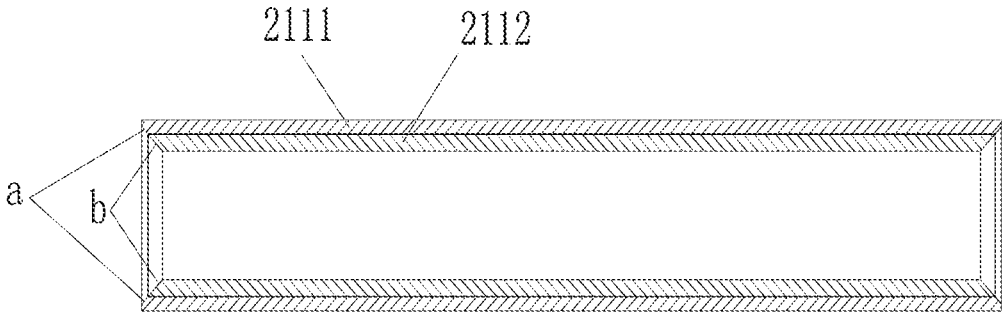
FIG. 19 is a sectional view of a sponge roller of a cleaner of the disclosure.
Figure 20:
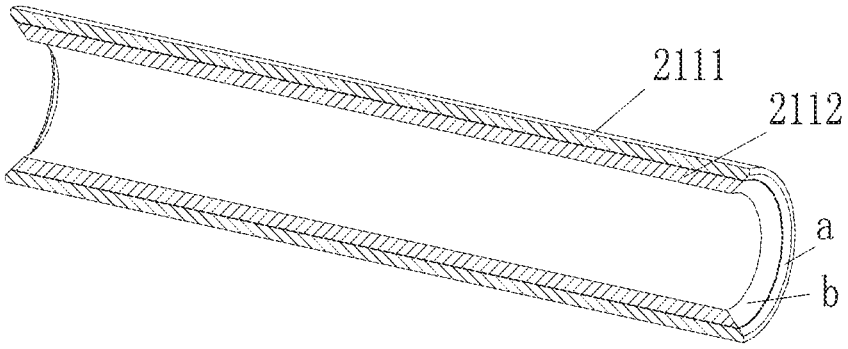
FIG. 20 is a sectional view of a sponge roller of a cleaner of the disclosure from another angle of view.

As shown in FIGS. 19 and 20, the sponge roller 211 comprises at least two layers, that is, an outer layer and an inner layer. The outer layer is an absorbent spongy layer 2111 and the inner layer is non-absorbent spongy layer 2112. The non-absorbent spongy layer 2112 is made of non-absorbent sponge and is incapable of absorbing water. The absorbent spongy layer 2111 is made of absorbent sponge, and water is mainly absorbed by the outer absorbent spongy layer 2111. Thus, to squeeze out water, only need to squeeze out water in the outer absorbent spongy layer 2111. Because the outer absorbent spongy layer is thinner than conventional spongy layer, the external force used for squeezing out water is gentle and does not impede the rotation of the sponge roller 211.

Conventionally, the sponge roller 211 is disposed in the base shell 120. Two ends of conventional cylindrical sponge roller are a circular surface vertical to the ground. The left and right side walls of the base shell 120 have a certain thickness, so that the sponge roller 120 cannot stretch into the region below the left and right side walls of the base shell 120 adjacent to the sponge roller 211 due to the circular structure of the sponge roller. As a result, the regions below the left and right side walls of the base shell 120 adjacent to the sponge roller 211 cannot be cleaned.

As shown in FIGS. 5, 6, 19 and 20, two ends of the sponge roller 211 are conical surfaces a and b. The conical surfaces a and b can stretch into the lower part of the left and right side walls of the base shell 120 adjacent to the sponge roller 211, thus cleaning the ground completely.

The control unit comprises a circuit board loading a control circuit and a man-machine interaction unit. Because the control unit is not the key point of improvement of the disclosure, no detailed description is provided herein. FIG. 3 shows keys of the man-machine interaction unit.

While particular embodiments of the disclosure have been shown and described, it will be obvious to those skilled in the art that changes and modifications may be made without departing from the disclosure in its broader aspects, and therefore, the aim in the appended claims is to cover all such changes and modifications as fall within the true spirit and scope of the disclosure.

What is claimed is:

1. A fluid channel assembly of a floor cleaner, the fluid channel assembly comprising:
- a shell defining a channel;
- a filter disposed in a pathway between the channel and a cleaning roller assembly;
- a seal element disposed on a first side of the channel; and
- a fluid-squeezing member disposed on a second side of the channel, wherein:
  - the second side of the channel is diametrically opposite the first side of the channel, and
  - the filter is disposed between the seal element and the fluid-squeezing member.

2. The fluid channel assembly of claim 1, wherein the seal element and the fluid-squeezing member contact a surface of the cleaning roller assembly to form a seal fitting.

3. The fluid channel assembly of claim 1, wherein:
- the fluid-squeezing member is made of hard material, and
- a wall of the fluid-squeezing member contacting the cleaning roller assembly is arc-shaped.

4. The fluid channel assembly of claim 1, wherein:
- the filter is a filtering screen, and
- a first end of the filtering screen contacts the seal element and a second end of the filtering screen contacts the fluid-squeezing member.

5. The fluid channel assembly of claim 1, wherein a first end of the shell defining the channel is coupled to a first fluid tank and a second end of the shell defining the channel is coupled to a second fluid tank.

6. A floor cleaner, comprising:
- a cleaning roller assembly comprising a cleaning roller configured to rotate about an axis; and
- a fluid channel assembly comprising:
  - a shell defining a channel;
  - a filter disposed in a pathway between the channel and the cleaning roller;
  - a seal element disposed on a first side of the channel; and
  - a fluid-squeezing member disposed on a second side of the channel, wherein:
    - the second side of the channel is diametrically opposite the first side of the channel, and
    - the filter is disposed between the seal element and the fluid-squeezing member.

7. The floor cleaner of claim 6, wherein the channel extends in a first direction parallel to the axis.

8. The floor cleaner of claim 6, comprising:
- a trash bin, wherein the seal element is disposed between the fluid-squeezing member and the trash bin in a direction of rotation of the cleaning roller.

9. The floor cleaner of claim 6, comprising:
- a scraper having an arc-shaped surface facing the cleaning roller; and
- a clearing component configured to clear the cleaning roller, wherein the clearing component is disposed in an opening between the scraper and the seal element.

10. The floor cleaner of claim 6, wherein the cleaning roller comprises:
- an outer layer having a first material composition; and
- an inner layer having a second material composition, wherein a first end of the outer layer has a tapered surface and a first end of the inner layer has a tapered surface.

11. The floor cleaner of claim 10, wherein the tapered surface of the outer layer and the tapered surface of the inner layer are co-planar.

12. The floor cleaner of claim 10, wherein:
- the inner layer is made of non-absorbent sponge, and
- the outer layer is made of absorbent sponge.

13. The floor cleaner of claim 6, wherein:
- the cleaning roller assembly comprises a motor and a sleeve barrel, and
- the sleeve barrel is sleeved on the motor.

14. The floor cleaner of claim 13, wherein the sleeve barrel and the cleaning roller are driven by the motor to rotate about the axis.

15. The floor cleaner of claim 6, comprising:
- a fluid tank coupled to the shell defining the channel and comprising:
  - a splash-proof member configured to separate the fluid tank into a buffer chamber and an accommodation chamber, wherein:
    - the fluid tank defines a first opening,
    - the splash-proof member is disposed between the first opening and the accommodation chamber,
    - the splash-proof member defines a first vent and a second vent, and
    - the buffer chamber is disposed between the first vent and the second vent.

16. The floor cleaner of claim 15, wherein the first vent provides for gas to flow in a first direction and the first opening provides for the gas to flow in a second direction different than the first direction.

17. A floor cleaner, comprising:
- a cleaning roller assembly;
- a seal element configured to contact the cleaning roller assembly;
- a fluid-squeezing member configured to contact the cleaning roller assembly; and
- a filter disposed between the seal element and the fluid-squeezing member, wherein the fluid-squeezing member, the seal element, and the cleaning roller assembly create a seal fitting for containing fluid in a space between the seal element and the fluid-squeezing member.

18. The floor cleaner of claim 17, comprising a shell defining a channel, wherein the filter is disposed in a pathway between the channel and the cleaning roller assembly.

19. The floor cleaner of claim 17, wherein:
- the cleaning roller assembly comprises a cleaning roller, and
- the cleaning roller comprises an outer layer having a first material composition and an inner layer having a second material composition.

20. The floor cleaner of claim 19, wherein a first end of the outer layer has a tapered surface and a first end of the inner layer has a tapered surface.

* * * * *